United States Patent [19]

Leppänen

[11] Patent Number: 4,710,065

[45] Date of Patent: Dec. 1, 1987

[54] METHOD, A DEVICE AND A MEANS FOR CARRYING OUT WIRE BOLTING OF A ROCK

[75] Inventor: Jarmo Leppänen, Ylöjärvi, Finland

[73] Assignee: Oy Tampella AB, Tampere, Finland

[21] Appl. No.: 920,597

[22] Filed: Oct. 20, 1986

[30] Foreign Application Priority Data

Nov. 7, 1985 [FI] Finland ..... 854377

[51] Int. Cl.[4] ..... E21D 20/02

[52] U.S. Cl. ..... 405/303; 405/259; 405/260

[58] Field of Search ..... 405/259, 260, 261, 303; 52/698, 704

[56] References Cited

U.S. PATENT DOCUMENTS

| | | | |
|---|---|---|---|
| 1,969,324 | 8/1934 | Poulter | 366/325 X |
| 1,982,610 | 11/1934 | Harris | 137/355.23 X |
| 2,055,885 | 9/1936 | Weston | 264/31 |
| 2,176,891 | 10/1939 | Crom | 264/31 |
| 2,274,883 | 3/1942 | Brach | 52/110 |
| 2,286,904 | 6/1942 | Ewald | 137/355.26 |
| 2,544,119 | 3/1951 | Wolfe | 138/138 |
| 2,692,092 | 10/1954 | Kinginger | 242/86.5 R |
| 2,930,199 | 3/1960 | Jarund | 405/260 |
| 2,985,404 | 5/1961 | Tashiro | 242/128 |
| 3,225,974 | 12/1966 | Athas | 222/529 |
| 3,273,813 | 9/1966 | George | 242/54 A |
| 3,379,019 | 4/1968 | Williams | 405/260 |
| 3,436,923 | 4/1969 | Lagerstrom | 405/260 |
| 3,520,725 | 7/1970 | Hamrick | 134/21 |
| 3,593,943 | 7/1971 | Collmann | 242/129 |
| 3,608,710 | 9/1971 | Pugh | 405/154 |
| 3,744,734 | 7/1973 | Lodato et al. | 242/129 |
| 3,809,333 | 5/1974 | Lefever | 242/129 |
| 3,815,845 | 6/1974 | Rygiol | 242/129 |
| 3,949,778 | 4/1976 | Woodford et al. | 137/355.16 |
| 3,999,391 | 12/1976 | Meredith | 405/260 |
| 4,066,093 | 1/1978 | Egerstrom | 137/355.2 |
| 4,079,592 | 3/1978 | Eakin | 405/260 |
| 4,085,492 | 4/1978 | Stange | 405/259 X |
| 4,116,368 | 9/1978 | Smith | 222/145 |
| 4,151,965 | 5/1979 | Manabe | 242/54 R |
| 4,253,813 | 3/1981 | Farrell, Jr. | 425/90 |
| 4,278,363 | 7/1981 | Choi | 405/259 X |
| 4,289,427 | 9/1981 | Rolston | 405/260 |
| 4,305,553 | 12/1981 | Coquerel | 242/86 |
| 4,344,553 | 8/1982 | Lesher et al. | 226/168 |
| 4,453,679 | 6/1984 | Thuries et al. | 242/54 A |
| 4,461,600 | 7/1984 | Norkus et al. | 405/269 |
| 4,514,111 | 4/1985 | Issakainen | 405/303 |
| 4,589,803 | 5/1986 | Totten | 405/303 |
| 4,601,518 | 7/1986 | Lanéus . | |
| 4,615,234 | 10/1986 | Chevance et al. | 74/501 R |
| 4,617,715 | 10/1986 | Koistinen et al. . | |
| 4,624,400 | 11/1986 | Zimmer | 226/188 |
| 4,643,619 | 2/1987 | Issakainen | 405/303 |

FOREIGN PATENT DOCUMENTS

| | | |
|---|---|---|
| 2526242 | 12/1976 | Fed. Rep. of Germany . |
| 1460292 | 10/1966 | France . |
| 1367404 | 9/1974 | United Kingdom . |

*Primary Examiner*—Dennis L. Taylor

*Attorney, Agent, or Firm*—Birch, Stewart, Kolasch & Birch

[57] ABSTRACT

A method for carrying out wire bolting of a rock, in which method a hole is drilled in a rock, and a wire piece shorter than the hole is pushed into the hole. In order to simplify the insertion, the wire piece is pushed into the hole by the same wire from which the wire piece has been cut. A wire bolting device developed for effecting the method comprises a cutting device mounted on the carrier of the device between a wire feeding mechanism and a resilient guide pipe attached to a head guide. A mounting space is provided beside the cutting device for the mounting of a pushing support between the ends of the cut wire.

4 Claims, 3 Drawing Figures

METHOD, A DEVICE AND A MEANS FOR CARRYING OUT WIRE BOLTING OF A ROCK

This invention relates to a method for carrying out wire bolting of a rock, wherein a hole is drilled in a rock, and a wire piece shorter than the hole is pushed into the hole.

In mechanized rock bolting, it is known to use a continuous wire as a bolt for a drill hole. The holes are drilled in the rock by means of an extension rod drilling equipment, whereafter a wire is pushed into the hole, which is filled with concrete either simultaneously or in advance. In particular, wire bolting is used for the supportion of rock portions positioned at a long distance from the bolting tunnel.

When rock is bolted in an excavation by means of wires going through the ore body, some major problems are caused by the wires remaining within the ore in connection with the blasting of the ore and the emptying of the ore body after the blasting. In production, excavation wires remaining within the ore may damage the drill bit. Also, the drill bit or the connecting socket of the drill rods may get stuck in the drilled blast hole. Further, such wires may hamper the emptying of the ore from the ore body and cause disturbances at some stage during the treatment of the ore.

In other kinds of rock bolting cases in which the rock portion to be supported is relatively far away from the bolting tunnel, excessive wire is passed into the drill hole in order to reach the rock portion to be supported. This results in unnecessary wire costs, and in numerous replacements of the wire reels which retards the bolting process.

It has been suggested previously that a wire cut into a determined length should be pushed to the bottom of the drill hole and that the length of the wire should be smaller than the total length of the drill hole and correspond to the length of that portion of the hole which is positioned within the rock to be supported. This way of bolting does make it possible to avoid the use of unnecessarily long wires. However, the bolting device becomes complicated and slow in operation on account of the pushing means developed for passing a cut wire piece to the bottom of the drill hole.

U.S. Pat. No. 4,040,329 discloses a device for the insertion of detonators into blast holes, and the same device is well suited for the insertion of wire pieces cut into a determined length into a drill hole in the wire bolting of rock.

SUMMARY OF THE INVENTION

Accordingly, it is an object of the present invention to provide a method which avoids the above disadvantages and enables a rock to be bolted in a simple manner by means of wire pieces shorter than the drill hole. The method according to the invention is characterized in that the wire piece is pushed into the drill hole by means of the same wire from which the wire piece has been cut.

The invention is based on the idea that the bolting of a drill hole by means of a wire piece shorter than the hole is in principle carried out in the same way as the bolting of a drill hole by means of full-length wires. The only difference is that part of the wire pushed into the hole is drawn back from the hole so that only that part of the wire which was pushed first into the hole remains in the drill hole. Accordingly, the method can be effected without any separate insertion means, because the wire itself and its feeding mechanism are utilized for carrying out the insertion. As the cutting of the wire piece to be left in the hole is carried out in connection with the bolting operation, no separate cutting means or separate passing of a wire cut in advance into a determined length into the drill hole are required, because the cutting and the feeding of the wire are carried out with the same equipment that in any case is used in wire bolting with full-length wires. The length of the wire piece is thereby easily variable to correspond to the length of the hole to be bolted in each particular case.

The invention is also concerned with means for guiding a wire in the wire bolting of a rock, which means are characterized in that said means is formed by a sleevelike pushing support which at least at one end is provided with a housing having the same diameter as the wire.

By means of this kind of pushing support it can be ensured that the end of a cut wire piece and that of a pushing wire are kept in alignment and that the ends of the wires do not fray during the pushing movement and, consequently, do not hamper the sliding of the wire within the drill hole. By providing the sleevelike pushing support with projecting gripping claws, the wire piece can be retained in the hole by means of the pushing support.

The invention is also concerned with a wire bolting device which is suited for applying the method according to the invention to mechanized wire bolting. The device is characterized in that the cutting means is mounted on the carrier of the device between the wire feeding mechanism and a resilient guide pipe attached to a head guide in such a manner that a mounting space is formed in the path of the wire beside the cutting means, in which space the wire is visible and through which said sleevelike pushing support can be mounted between the ends of the wire after the wire has been cut.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be described more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
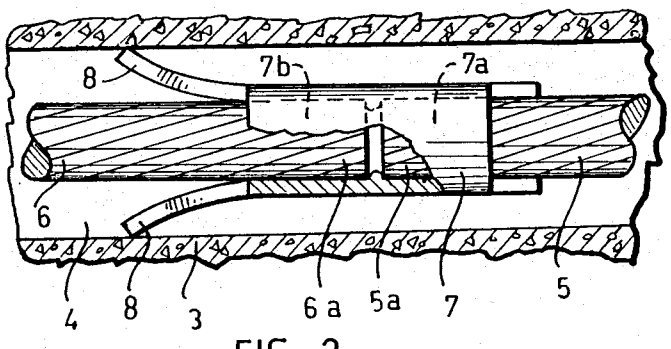
FIG. 2 is a partial axial section of a sleevelike pushing support suited for joining the ends of a cut wire.
Figure 1:
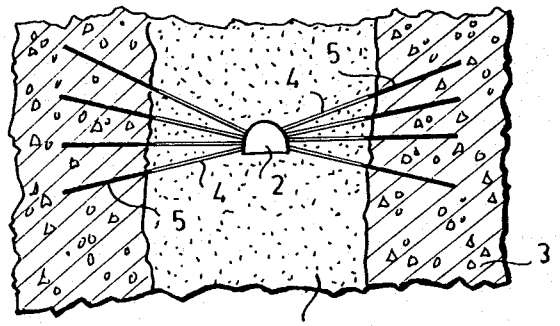
FIG. 1 is a schematic vertical section of a rock bolting carried out according to the present invention.
Figure 3:
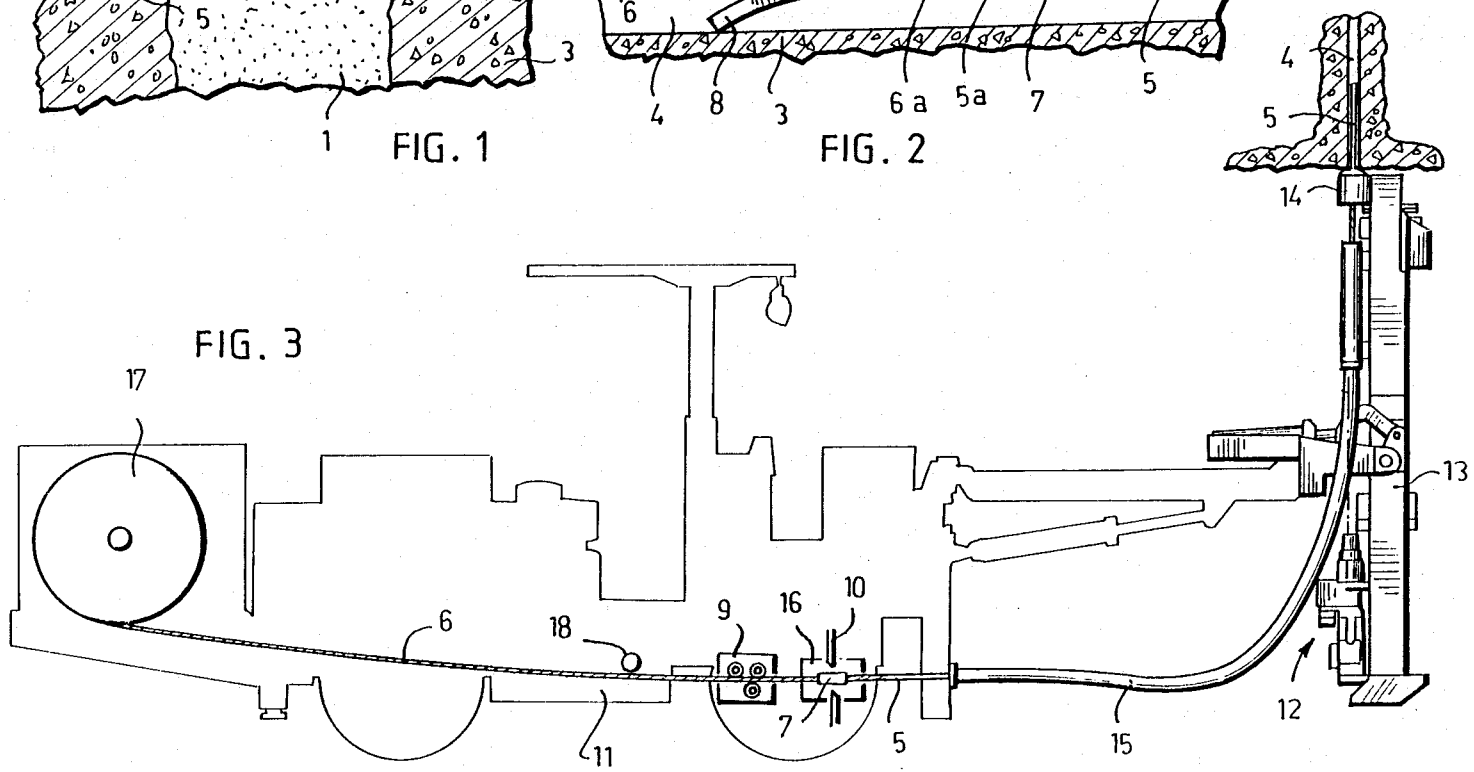
FIG. 3 is a schematic side view of a wire bolting device designed for applying the method according to the invention.

In the bolting case shown in FIG. 1 of the drawing, the bolting is carried out from within the ore body through the ore. Tunnels 2 are formed in the ore body 1 for the drilling the blast holes. Holes 4 are drilled from within the tunnel through the ore body into the surrounding rock 3, and a wire piece 5 is pushed into each hole for the supportion of the rock, the wire piece being shorter than the total length of the drill hole.

The wire piece 5 is cut from a wire 6 used in the bolting operation, as will be described in more detail below. A sleevelike pushing support 7 is fitted between the ends 5*a* and 6*a* of the cut wire. The pushing support comprises two housings 7*a* and 7*b* opening to axially opposite directions, the inner diameter of the housings corresponding essentially to the outer diameter of the wire. In its simplest form, the pushing support can be formed of a split tightening sleeve which can be clamped around the end of a cut wire piece and which is prevented from sliding axially with respect to the cut wire piece in any suitable manner.

After the pushing support has been mounted, the wire is fed into the drill hole until the cut wire piece reaches the bottom of the drill hole. Thereafter the pushing wire is drawn off the pushing support and out of the drill hole. In order that the wire piece left at the bottom of the drill hole would not be displaced outwards in the hole, the pushing support is provided with projecting claws 8 which grip the wall of the drill hole and maintain the wire piece in position in the hole.

In mechanized wire bolting, it is advantageous to mount the wire feeding mechanism 9 and the cutting means 10 on the carrier 11 of the bolting device. A resilient guide pipe 15 of a determined length is mounted between the carrier and a head guide 14 supported by a feeding beam 13 of the drilling equipment 12, through which pipe the wire is passed from the cutting means into the head guide and further into the drill hole. A mounting space 16 is provided in the path of the wire beside the cutting means over a short distance, e.g. 150 mm, wherein the wire is visible before it is pushed into the guide pipe and through which the wire is cut and the pushing support is mounted between the ends of the wire after it has been cut.

A measuring apparatus 18 is provided between a wire reel 17 and the feeding mechanism for measuring the feed of the wire, whereby the right cutting point of the wire is passed within the mounting space of the cutting means on the basis of the measuring result obtained by means of said apparatus.

By means of this kind of arrangement the pushing support 7 can be mounted simply by hand or in a mechanized manner on the carrier, and the wire can be fed into the drill hole as a continuous string in spite of the point of discontinuity.

The drawing and the description related thereto are only intended to illustrate the idea of the invention. In their details, the method, the pushing support and the bolting device according to the invention may vary within the scope of the claims. Even though the pushing support can obviously be mounted most advantageously on the carrier, it is possible to mount the pushing support between the ends of the cut wire at some other point of the path of the wire, e.g. on the feeding beam 13. At its simplest, the pushing support can be an ordinary pipe piece which is attached to the wire piece to be pushed e.g. by welding. Also, the pushing support can be formed by a sleevelike cup the bottom of which is welded fast to the wire piece to be pushed. Accordingly, the separating wall is not necessary between the housings. In certain cases, one gripping claw only may suffice for the pushing support.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wire bolting device comprising:

a wire magazine holding at least one continuous wire;

a feeding mechanism for withdrawing the continous wire from the wire magazine;

wire cutting means for cutting the continous wire to form a cut wire section, said wire cutting means receiving said continuous wire to be cut from said feeding mechanism;

a guide pipe for receiving the cut wire section from the cutting means;

a head guide for receiving the cut wire section from said guide pipe, said head guide being positionable close to a drill hole having a depth, said cut wire section being pushed through said guide pipe and said head guide and into said drill hole by the remaining uncut continous wire being fed by the feeding mechanism, said cut wire section pushed into said drill hole being capable of being shorter in length than the depth of said drill hole;

a feeding beam for supporting said guide; and a carrier upon which said feeding beam is mounted, said carrier additionally mounting drilling equipment.

2. The wire bolting device as recited in claim 1, wherein said guide pipe extends between said carrier and said head guide, said guide pipe serving to guide said cut wire section from said cutting means to said head guide.

3. The wire bolting device as recited in claim 1, wherein a mounting space is provided adjacent said cutting means, said mounting space permitting said cut wire section to be joined to said continuous wire by a means for joining said cut wire section to said continuous wire.

4. The wire bolting device as recited in claim 3, wherein said means for joining includes a sleeve-like pushing support.

* * * * *